United States Patent [19]

McNamara

[11] 4,202,255

[45] May 13, 1980

[54] CHIMNEY CAP

[76] Inventor: Joseph R. McNamara, 90 Dana Ave., Worcester, Mass. 06104

[21] Appl. No.: 954,301

[22] Filed: Oct. 23, 1978

[51] Int. Cl.[2] ..... F24F 7/00

[52] U.S. Cl. ..... 98/42 R; 52/199; 52/244; 98/58; 98/67; 98/122

[58] Field of Search ..... 52/199, 200, 244; 98/58, 42 R, 122, 67

[56] References Cited

U.S. PATENT DOCUMENTS

| | | | |
|---|---|---|---|
| 30,345 | 10/1860 | Pertigell | 52/199 |
| 80,618 | 8/1868 | Frailey | 52/244 |
| 188,156 | 3/1877 | Lemmle | 52/244 |
| 212,104 | 2/1879 | McNamara | 98/67 |
| 286,597 | 10/1883 | Faulstich | 52/244 |
| 307,274 | 10/1884 | Early | 52/244 |
| 311,105 | 1/1885 | Conway | 52/244 |
| 355,944 | 1/1887 | Melander | 52/244 |
| 390,857 | 10/1888 | Hansen | 52/244 |
| 405,667 | 6/1889 | Hinkley | 52/244 |
| 473,853 | 4/1892 | Raymond | 52/244 |
| 581,505 | 4/1897 | Barker | 52/244 |
| 650,026 | 5/1900 | Schoppe | 52/244 |
| 719,489 | 2/1903 | Mique | 52/244 |
| 740,247 | 9/1903 | Cross | 52/199 |
| 829,104 | 8/1906 | Dixon | 52/244 |
| 851,949 | 4/1907 | Leak | 52/244 |
| 957,544 | 5/1910 | Canivan | 52/244 |
| 1,096,737 | 5/1914 | McManan | 52/244 |
| 1,940,566 | 12/1933 | Schroeder | 52/244 |
| 2,183,402 | 12/1939 | Kepple | 52/244 |
| 2,234,313 | 3/1941 | Mutter | 52/199 |
| 2,300,088 | 10/1942 | Artis | 98/67 |
| 2,328,731 | 9/1943 | Lovely | 98/67 |
| 2,365,854 | 12/1944 | Albaugh | 98/67 |
| 2,417,039 | 3/1947 | Albaugh | 98/67 |
| 2,646,743 | 7/1953 | Van Alstyne | 98/83 |
| 2,660,105 | 11/1953 | Sabin, Jr. | 98/78 |
| 2,766,678 | 10/1956 | Morris | 98/67 |
| 3,425,178 | 2/1969 | Stone et al. | 52/244 |
| 3,685,426 | 8/1972 | Rosa | 52/200 |

*Primary Examiner*—Ronald C. Capossela
*Attorney, Agent, or Firm*—Ross, Ross & Flavin

[57] ABSTRACT

A chimney cap of concrete construction which can be conveniently carried to the situs at the upper terminus of a chimney and readily secured thereto, to offer the purposes of keeping the rain and snow out of the chimney stack and of preventing downdrafts and of providing screening therewith so as to define spark arresters in the event of the escape of sparks through the chimney top.

1 Claim, 5 Drawing Figures

CHIMNEY CAP

The following is a listing of the United States Letters Patents which the applicant believes to be the closest prior art of which he is aware:

U.S. Pat. Nos. 30,345; 80,618; 188,156; 212,104; 286,597; 307,274; 311,105; 355,944; 390,857; 405,667; 473,853; 581,505; 650,026; 695,170; 719,469; 740,247; 829,104; 851,949; 957,544; 1,096,737; 1,940,566; 2,183,402; 2,234,313; 2,300,088; 2,328,731; 2,365,854; 2,417,039; 2,660,105; 2,646,743 and 3,425,178 .

Copies of the listed patents are attached hereto. The patents are believed to be relevant in that they disclose various chimney cap structures. However, none is believed to disclose the features of Applicant's construction in the form of a unit which can be conveniently carried to the situs of the upper terminus of a chemney and readily secured thereto and which offers the purposes of keeping the rain and snow out of the chimney stack and of providing screenings therewith which serve as spark arresters in the event of the escape of sparks through the chimney top.

GENERAL DESCRIPTION OF THE INVENTION

My invention relates to an improvement in chimney-tops of the class intended for use upon the ordinary, usually brick, chimneys of buildings.

The primary object is to provide a construction of chimney-top which shall be adapted to be quickly and rigidly secured to the tops of chimneys of different sizes and shapes, thus rendering unnecessary in the manufacture of such devices the making of a special size of chimney-top for each different size of chimney. It can be secured to any type of chimney construction, whether it be of brick or concrete block or other type of design.

Another object is to provide a construction the parts of which may be nested together in packing for shipment, and which may be readily assembled when required for use.

Another object is to provide a chimney cap which in use is mounted on and covers the exposed terminal edge of a chimney construction and which serves to prevent downdrafts. Additionally, it can be easily removed for cleaning and other purposes.

The cap is of such configuration as to provide water-tight connections around its perimeter both at the top and at the base.

Most significantly, it is of such configuration as to allow the use of two or more caps in tandem or series depending on the number and size of the flue or flues employed. That is, the top dimension is the same as the base dimension so as to permit side-by-side placement of caps with each other, all without interference.

The invention provides a chimney cap of concrete construction which can be conveniently carried to the situs of the upper terminus of a chimney and readily secured thereto, to offer the purposes of keeping the rain and snow out of the chimney stack and of providing replaceable screenings therewith so as to define spark arresters in the event of the escape of sparks through the chimney top. In the drawings.

Figure 1:
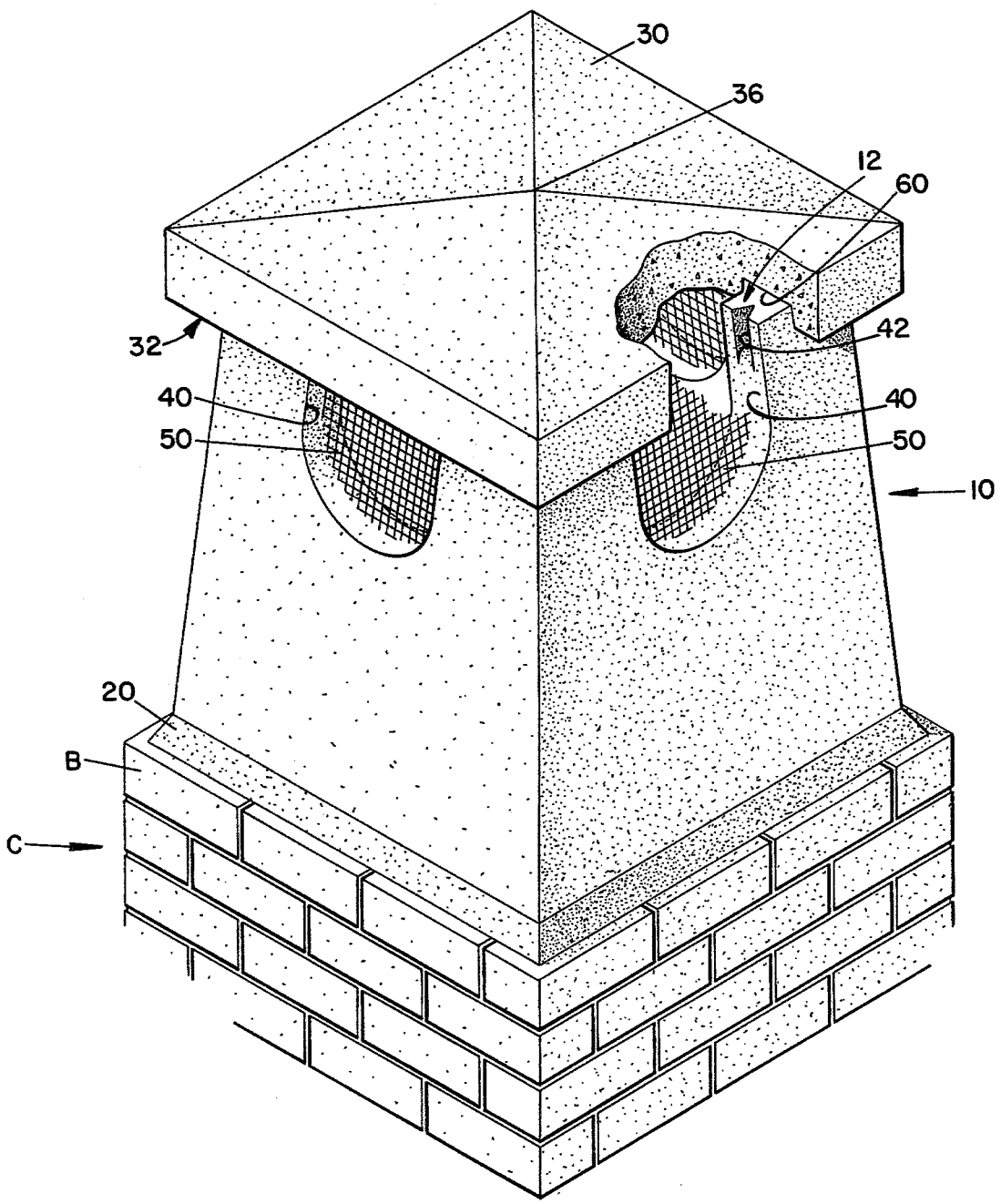
FIG. 1 is a view, in perspective, of a chimney cap in situ on a chimney terminus, with certain parts broken away for the sake of clarity.
Figure 5:
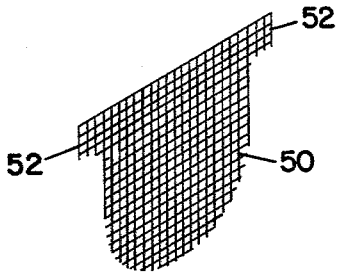

FIG. 5 is a view in perspective of one of the screens of the chimney cap of FIG. 1. As shown, the body of the chimney cap comprises a four-sided hollow body 10 which may incorporate a slight inward taper from its lower to its upper planar edge 12, with the lower planar edge being adapted to seat specifically upon the top course of bricks B at the upper terminus of a chimney C with the body being adapted to be secured to the chimney as by a course of cement 20, and with the body being receivable over the topmost portion of a flue F which will normally project upwardly above the top plane of chimney C.

A roof 30 of generally square configuration seats upon the upper planar surface of the body 10 and is of such dimension as to provide a slight overhang 32 at each side of the body.

Figure 2:
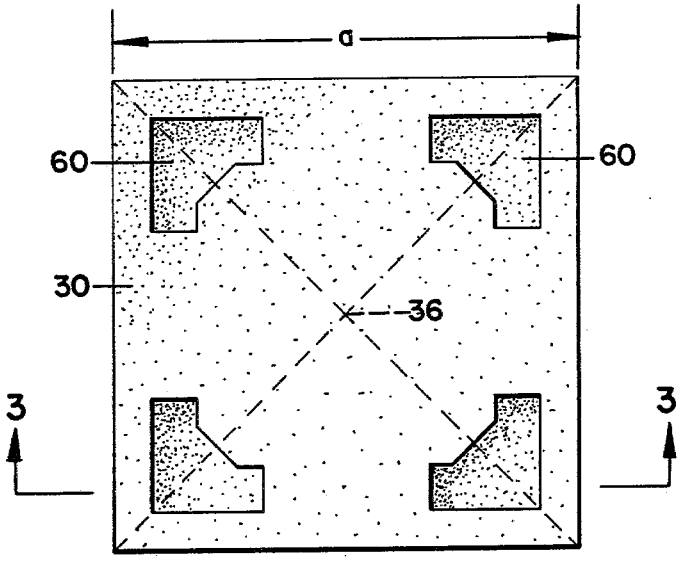
FIG. 2 is an inverted view, of the roof of the chimney cap of FIG. 1.
Figure 3:
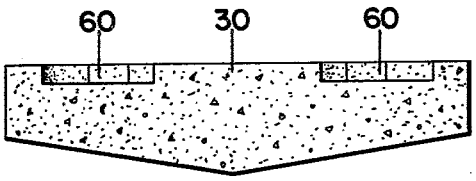
FIG. 3 is a sectional view on line 3—3 of FIG. 2.
Figure 4:
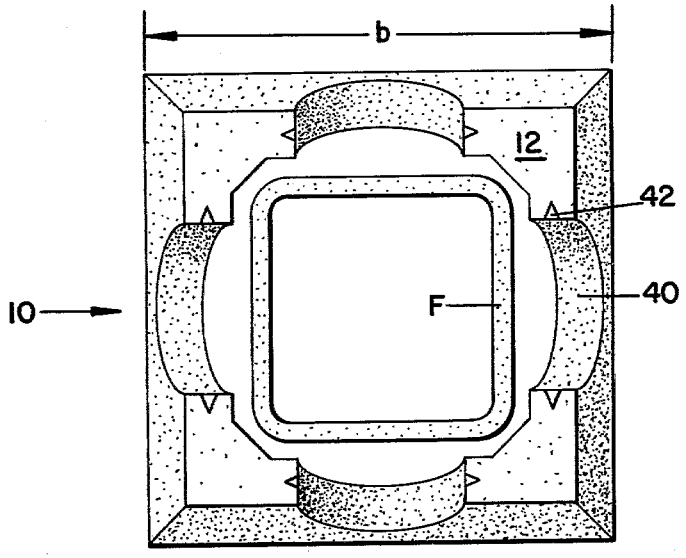
FIG. 4 is a view in top plan, of the body of the chimney cap of FIG. 1.

As seen in FIGS. 2 and 4, the dimension a of roof 30 is the same as the dimension b of base 10 so as to permit side-by-side placement of caps with each other without interference when two or more caps are used in tandem or in series.

The upper surface of the roof may be tapered on each side toward a central crown 36 so that rain water and snow will be encouraged to run off therefrom.

The body 10 will be provided with arcuate recesses 40 adjacent each side thereof, which recesses will communicate at each end thereof with inwardly extending veeshaped slots 42 extending into the walls of the body, and into each recess 40 and its respective pair of slots 42 a screen member 50 will be receivable.

The screen member 50 is of a configuration adapted to be receivable snugly within the recess having at each side thereof an ear 52 so as to adapt it to be received in the respective slot 42.

The underside of the roof is provided with a recess 60 adjacent each respective corner thereof, which recesses are of such dimension and configuration as to adapt the roof to be snugly seated upon the upper planar edge 12 of body 10 which is complementally configured at its respective corners to the configuration of the recesses to provide a strong water-tight connection between roof and body.

I claim:

1. A chimney cap which can be conveniently carried to the situs at the upper terminus of a chimney and readily secured thereto comprising, an upright hollow body having walls terminating in upper and lower planar edges, the lower planar edge of the body being secured to the upper terminus of the chimney, a roof seated upon the upper planar edge of the body, the width of the roof being the same as the width of the lower planar edge of the body, the underside of the roof being provided with recesses adjacent each respective corner and the upper planar edge of the body being appropriately complementally configured to snugly seat in said recesses, substantially arcuate recesses extending through the walls of the body adjacent each side thereof, the arcuate recesses communicating at each end thereof with inwardly extending veeshaped slots extending into the walls of the body, and screen members of a configuration adapted to be removably receivable snugly within the annular recesses in the body, the screens having at each side thereof an ear receivable in the respective veeshaped slots.

* * * * *